US005375564A

United States Patent [19]

Gail

[11] Patent Number: 5,375,564

[45] Date of Patent: Dec. 27, 1994

[54] ROTATING CYLINDER INTERNAL COMBUSTION ENGINE

[76] Inventor: Josef Gail, Klausenweg 4, 8894 Aichach-Unterwittelsbach, Germany

[21] Appl. No.: 793,431

[22] PCT Filed: Jun. 12, 1990

[86] PCT No.: PCT/EP90/00924

§ 371 Date: Dec. 10, 1991

§ 102(e) Date: Dec. 10, 1991

[87] PCT Pub. No.: WO90/15918

PCT Pub. Date: Dec. 27, 1990

[30] Foreign Application Priority Data

| | | | |
|---|---|---|---|
| Jun. 12, 1989 | [DE] | Germany | 3919168 |
| Sep. 27, 1989 | [DE] | Germany | 3932179 |
| Nov. 23, 1989 | [DE] | Germany | 3938793 |

[51] Int. Cl.[5] ..... F02B 57/06

[52] U.S. Cl. ..... 123/44 C; 91/493; 60/39.6; 123/44 D

[58] Field of Search ..... 91/493; 123/44 R, 44 D, 123/44 C; 60/39.6

[56] References Cited

U.S. PATENT DOCUMENTS

| | | | |
|---|---|---|---|
| 1,220,455 | 3/1917 | Rasmussen | 123/44 D |
| 1,681,454 | 8/1928 | Aber | 123/44 C |
| 2,683,422 | 7/1954 | Richards | 123/44 R X |
| 3,665,811 | 5/1972 | Van Avermaete | 91/493 |
| 3,799,035 | 3/1974 | Lamm | 91/493 |
| 3,921,602 | 11/1975 | Froumajou | 123/44 D |
| 4,040,398 | 8/1977 | Billings et al. | 123/44 R |

FOREIGN PATENT DOCUMENTS

| | | | |
|---|---|---|---|
| 0025071 | 3/1981 | European Pat. Off. . | |
| 2502709 | 7/1975 | Germany . | |
| 2536739 | 3/1977 | Germany . | |
| 3619612 | 12/1987 | Germany . | |
| 36205 | 3/1977 | Japan | 123/44 D |
| 1052001 | 12/1966 | United Kingdom . | |
| 1446852 | 8/1976 | United Kingdom . | |
| 88/08483 | 11/1988 | WIPO . | |

OTHER PUBLICATIONS

Fink, MTZ 30 (1969) pp. 142–144.

Klein, "Der Konstrukteur" May. 1986 pp. 6–16.

*Primary Examiner*—Michael Koczo, Jr.

*Attorney, Agent, or Firm*—Anderson Kill Olick & Oshinsky

[57] ABSTRACT

The reciprocating engine which is particularly useful as an internal combustion engine, comprises a housing (1) with, mounted to rotate about a first axis of rotation (7), a cylinder rotor (5) having three pairs of cylinders (15) which are angularly offset in respect of one another by 120° about the first axis of rotation (7). Disposed in the cylinders (15) are pistons (17) which are rigidly connected to one another in pairs by piston rods (19). Also mounted in the housing is a crank shaft (23) which is rotatable about a second axis of rotation (25) which is axially parallel with and offset by a predetermined eccentricity (e) in relation to the first axis of rotation (7). The piston rods (19) of the pairs of pistons are guided on the crank shaft (23) by means of eccentric bearings (27, 31). The eccentric bearings (27, 31) define in relation to the crank shaft (23) fixed axes of rotation (33) which, are angularly offset by 120° in respect of one another. The cylinder rotor (25) is torsionally rigidly coupled to the crank shaft (23) solely via the piston rods (19) and their eccentric bearings (27, 31) which are fixed in relation to the crank shaft. The fresh air compressed by a waste gas supercharger (37, 39) is fed to the internal combustion engine via a heat exchanger (45) in order to increase the efficiency.

17 Claims, 4 Drawing Sheets

ROTATING CYLINDER INTERNAL COMBUSTION ENGINE

The invention relates to a reciprocating engine, particularly a reciprocating internal combustion engine.

Known from German Offenlegungsschrift No. 25 02 709 is a reciprocating internal combustion engine having a cylinder rotor which is mounted to rotate about an axis of rotation housing which forms the engine base. The cylinder rotor contains four cylinders which, angularly offset by 90° in respect of one another, are disposed in pairs about the axis of rotation of the cylinder rotor, coaxially with a cylinder axis extending at right-angles to the axis of rotation. Disposed for displacement in the cylinders are pistons which are in turn connected rigidly to one another in pairs by piston rods. Mounted equiaxially with the cylinder rotor in the housing is a crank shaft, the crank arm of which carries rotatable cam discs which are in turn rotatably mounted in bearing apertures in the piston rods. The eccentricity of the cam discs is equal to the eccentricity of the crank arm of the crank shaft. Upon rotation of the cylinder rotor and of the crank shaft, the pairs of pistons move on a rectilinear path through the axis of rotation of the cylinder rotor. Internal combustion engines of this type have comparatively low piston speeds at low cylinder rotor speed and offer a high output for comparatively small overall volume. Furthermore, they offer only minimal imbalance.

In the case of the internal combustion engine described hereinabove, the cylinder rotor is required to rotate at a speed which is equal to half the rotary speed of the crank shaft. For this purpose, the cylinder rotor is rotationally rigidly coupled to the crank shaft via a planetary gearing. The planetary gearing has, seated on the crank shaft, a sun wheel of comparatively small diameter which has to accommodate the entire moment of reaction of the cylinder rotor and which must accordingly be of large dimensions. It has been found that with adequate dimensioning, the planet gearing can occupy a substantial part of the overall volume of the internal combustion engine.

In the case of an internal combustion engine of the above described known type, the piston travel corresponds to four times the eccentricity of the cam discs or of the crank arm of the crank shaft. Since the piston travel cannot be of any desired length for reasons which relate to design and combustion technology, there are imposed on the eccentricity of the cam discs or the crank arm structural limits which cannot be exceeded. On the other hand, the double mounting of the cam disc on the crank arm on the one hand and on the piston rod on the other does require a certain overall space which first and foremost can only be provided by weakening the crank pin diameter. Weakening the crank pin however does limit the maximum output which can be generated by the internal combustion engine.

Known from DE-OS 25 36 739 is a similar internal combustion engine with a cylinder rotor and with, angularly offset by 90° about the axis of rotation of the cylinder rotor, two pairs of cylinders and which differs from the internal combustion engine according to DE-OS 25 02 709 mainly in that the crank shaft is not equiaxially but axially parallel and eccentrically disposed in relation to the axis of rotation of the cylinder rotor. Also with this internal combustion engine, the cylinder rotor is positively driven by the crank shaft through a gear mechanism which means that the aforementioned structural disadvantages apply.

It is known from MTZ 30 (1969) 4, pages 142 to 144 to construct an internal combustion engine of the aforedescribed type not only with two pairs of cylinders but as a 6-cylinder engine. But also with this internal combustion engine, the cylinder rotor is coupled to the crank shaft through a planetary gearing and the piston rods of the individual pistons are guided by cam discs on the crank shaft which are rotatably mounted both on the crank arm of the crank shaft and also in the piston rod. Here, again, the aforesaid disadvantages apply.

An internal combustion engine having, offset by 120° in respect of one another, three pairs of cylinders in a common cylinder rotor is known from U.S. Pat. No. 3,665,811. The cylinder axes lie in a common plane at right-angles to the axis of rotation of the cylinder rotor and the pairs of pistons displaceable in the pairs of cylinders are connected to one another rigidly via piston rods. The piston rods of three pairs of pistons are connected to a common crank shaft through eccentric bearings, while the axis of the common crank shaft is offset axially parallel to and with a predetermined eccentricity in respect of the axis of the cylinder rotor. The eccentric bearings are angularly offset by 120° in respect of one another about the crank shaft axis and comprise in each case circular cam discs which are fixed in relation to the crank shaft and which are guided by means of plain bearings in bearing apertures in the piston rods. Coupled to the crank shaft of the internal combustion engine is a compressor of the same type, which supercharges the engine.

In the case of the internal combustion engine known from U.S. Pat. No. 3,665,811, each pair of pistons can itself be rotationally rigidly supported on the cylinder through its eccentric axis defined by its eccentric bearing, if the eccentric axis does at any one moment coincide with the axis of rotation of the cylinder rotor. This supporting effect is achieved solely via the other pairs of pistons, without the cylinder rotor having to be torsionally rigidly coupled to the crank shaft via a gear mechanism or the like. A reciprocating engine of this type therefore has the advantage that each of the three pairs of pistons is in each of the three angular positions of the cylinder rotor provided with stable guidance on the crank shaft. This diminishes rotary resonance such as might occur in the case of previously described internal combustion engines with a cylinder rotor and with double-mounted compensating cams on the crank shaft.

Even though a reciprocating engine of this type is of smaller dimensions than the piston engines described at the outset and which had double-mounted cam discs, it still often happens that the dimensions are too great particularly if the piston engine is to be dimensioned for relatively high output levels. For higher output levels, it is desirable on the one hand to keep the axial dimensions of the crank, shaft as small as possible in order to be able to minimise the tilting moments which act on the crank shaft. On the other hand, a sufficiently large bearing circle diameter and a sufficiently large cross-sectional area of the crank shaft must be provided in order to be able to cope with the forces which act on the crank shaft at relatively high output levels. In the case of the reciprocating engine known from U.S. Pat. No. 3,665,811, the radius of the circular cam discs is smaller than the eccentricity of the crank shaft, i.e. smaller than the distance between the axes of rotation of the cams from the axis of rotation of the crank shaft. This means that the overall axial length of the internal combustion engine is increased by crank webs which connect the circular cam discs to one another. The comparatively small bearing circle radius of the circular cam discs in conjunction with the sharply cranked disposition of the piston rods restricts the output attainable by the known internal combustion engine.

The problem on which the invention is based is that of so improving a reciprocating engine of the aforementioned type which has, offset by 120° in respect of one another, three pairs of cylinders that it can be dimensioned for higher output levels while retaining comparatively small dimensions.

A reciprocating engine according to the invention, and in particular a reciprocating internal combustion engine, similar to the engine known from U.S. Pat. No. 3,665,811, comprises an engine base and a cylinder rotor mounted on the engine base and rotatable about a first axis of rotation and which comprises at least one group of three pairs of cylinders angularly offset by 120° in respect of one another and disposed about the first axis of rotation and of which the cylinders forming the pairs are disposed on opposite sides of the first axis of rotation and have the same cylinder axis which is at right-angles to the first axis of rotation. Displaceably disposed in the cylinders are pistons of which the pistons associated with the pairs of cylinders are rigidly connected to one another in pairs by piston rods. Mounted on the engine base and adapted for rotation about a second axis of rotation which is axially parallel with and offset by a predetermined eccentricity in relation to the first axis of rotation is a crank shaft on which the piston rods of the pairs of pistons are guided by means of eccentric bearings. The eccentric bearings are in turn angularly offset in respect of one another by 120° about the second axis of rotation and define third axes of rotation which are fixed in relation to the crank shaft and of which each one is likewise offset by the predetermined eccentricity and in an axially parallel relationship in respect of the second axis of rotation. The eccentric bearings comprise, connected rigidly to the crank shaft, circular cam discs the disc axis of which define the third axes of rotation and which are rotatably seated in bearing apertures in the piston rods. The cylinder rotor is thus torsionally rigidly connected to the crank shaft solely via the piston rods.

In contrast to the reciprocating engine known from U.S. Pat. No. 3,665,811, the bearing circle radius of the circular cam discs is according to the invention on the one hand larger than the predetermined eccentricity while the ratio of the bearing circle radius of the circular cam discs in relation to the predetermined eccentricity is less than 4.

With such dimensioning, the crank webs which are required in prior art reciprocating engines and which are disposed on both sides of the circular cam discs become unnecessary so that the overall axial length of the crankshaft can be kept short. The circular cam discs can follow one another axially and substantially directly, the material cross-section in the area of the overlap of the circular cam discs also being adequately dimensioned for the transmission of high radial forces.

In order to be able to accommodate comparatively high piston forces, the largest possible bearing circle diameter of the circular cam discs is sought. Surprisingly, it has been found that during rotary driving of the cylinder rotor, for example by reason of the moment of inertia of the rotating cylinder rotor, becomes self-locking if the bearing circle diameter is increased beyond specific limits. By virtue of the toggle-lever action of the circular cam discs guided in the bearing apertures of the piston rods, each of the pairs of pistons, under a driving loading from the cylinder rotor, has a cylinder rotor angular range within which self-locking would occur if it were not followed up by the positive guidance of the two other pairs of pistons. The bearing circle diameter of the circular cam discs is therefore, according to the invention, of such small dimensions that the self-locking angular range of each individual pair of pistons in relation to the rotation of the cylinder rotor, is in each case somewhat smaller than 60°. The choice of the dimensions depends upon the coefficient of friction of the eccentric bearing and of the piston in the cylinder and on the eccentricity of the eccentric bearing. Within the framework of the invention, therefore, the self-locking of in each case one individual pair of pistons is taken into account intentionally and dimensioning of the eccentric bearing ensures that the self-locking angle ranges of two pairs of pistons cannot overlap which would lead to a complete shut-down of the reciprocating engine. The self-locking effect is according to the invention avoided if the ratio of the bearing circle radius of, the circular cam discs to their eccentricity expediently less than 4 and preferably less than 3.

In order to minimize the bearing friction on the eccentric bearings, they are ideally constructed as needle bearings. The needle bearing of the middle cam disc and thus also the middle piston rod can, by virtue of the minimal axial dimension of the crank shaft, be pulled over the outer circular cam discs in an undivided state. In a preferred development, the working surfaces are formed directly by the bearing aperture, undivided in the peripheral direction, and by the periphery of the circular cam disc.

For use as an internal combustion engine, the cylinders are charged with fuel-air mixture one after another in the region of their radially outer dead centre position which, at least as far as the fresh air fraction is concerned, is preferably compressed via a precedent compressor. It has been found that the combustion chamber can be more satisfactorily filled with pre-compressed mixture if a small amount of dead space is taken into account in the radially outer dead point position of the piston and if the gas inlet aperture through which the pre-compressed mixture is fed, is so disposed that the volume of dead space can be filled with mixture even before the piston has reached the radially outer dead centre position. The volume of dead space can be made available by a radial over-dimensioning of the cylinder. The increase in the radial dimensions of the cylinder rotor can however be avoided if instead at least one depression is provided in the crown of the piston.

For pre-compressing the fresh air, a compressor may be provided which is driven by a waste gas turbine. Such a waste gas turbine requires a comparatively high starting pressure in the waste gases in order to operate economically and this therefore prevents the change of load. The load change situation can be improved if, as envisaged under a further aspect of the invention, the gas outlet orifice provided in the housing is subdivided into two separate outlets which follow each other in the peripheral direction and of which the first outlet to be charged during rotation of the cylinder rotor is connected to the waste gas turbine. Ideally, the waste gas turbine is expediently driven by the waste gases emerging at high pressure in the area of rotation which is adjacent the radially inner dead centre position of the piston. Once the waste gases have partially expanded, they are during the course of further rotation of the cylinder rotor forced out through the subsequent orifice at comparatively low counter-pressure. Part of the wall of the housing between the two outlets which is wider than the cylinder aperture at the circumference of the cylinder rotor, prevents a direct shunting of the waste gases between the two outlets.

In accordance with a further preferred aspect of the invention, the cylinders of the cylinder rotor are closed off radially on either side of the piston to form two chambers which are separated from each other by the piston. Separate gas inlet apertures and separate gas outlet orifices are in each case associated with the radially inner chambers and the radially outer chambers. As a result of this measure, the working volume of the reciprocating engine can be increased substantially without enlarging the overall dimensions. The radially inner chambers can be used as the working spaces of a compressor which charges the radially outer chambers with pre-compressed gas. The radially outer chambers can, to form a double compressor, likewise be constructed as compressor working spaces or form the combustion chambers of an internal combustion engine. Both alternatives are characterised by high output for minimal structural volume.

The pistons may be of circular cross-section but they are preferably narrower in the peripheral direction of the cylinder rotor than in its axial direction. In this way, the cross-section available for accommodating the cylinders in the cylinder rotor can be better utilised so that the swept capacity can be increased without increasing the diameter of the cylinder rotor. The pistons may have a rectangular cross-section or may have semi-cylindrical narrow sides which are adjacent the otherwise plane broad sides of the piston. Both versions offer the advantage that they can be sealed in respect of the cylinder by means of segmented sealing strips, i.e. sealing strips which are formed from a plurality of portions. If the piston is of rectangular cross-section, the sealing strips expediently overlap at the transition from the broad sides to the narrow sides. With semi-cylindrically shaped narrow sides, preferably U-shaped sealing strips are used which enclose the narrow sides between their arms. Overlapping sealing strips can in the present case be used since by virtue of the design of the reciprocating engine no high peaks of pressure arise in the combustion spaces. On the other hand, it is expedient to use ceramic material for the pistons in order thus to be able to work at very high combustion gas temperatures in order to improve efficiency.

The cylinders are expediently open towards the periphery of the cylinder rotor and are closed off outwardly by a housing which closely surrounds the periphery of the cylinder rotor. An annular gap remaining between the peripheral wall of the housing and the peripheral surface of the cylinder rotor can be compensated for if both the peripheral surface of the cylinder rotor and also the inside surface of the peripheral wall of the housing which encloses the cylinder rotor is slightly conical and if the peripheral wall is axially adjustable.

The combustion spaces of the cylinders can be filled with pre-compressed mixture following the radially outer dead centre position of the pistons and fired within the combustion chambers at an angular distance from the radially outer dead center position. This has the advantage that pressure peaks are created at an angular distance from the radially outer dead centre position which reduces the loading on the crank shaft. Alternatively, however, it is also possible to provide a combustion chamber which is rigidly disposed in the housing and in which pre-compressed fuel-air mixture can be remotely fired from outside the cylinder, only then being introduced into the cylinder through the gas inlet aperture. Ideally, the fresh air is introduced into the combustion chamber through a non-return valve in order to relieve the compressor of the combustion pressure of the ignited combustion gases. Here, too, the ignited combustion gases are expediently fed to the cylinder at an angular distance from the radially outer dead centre position.

The efficiency of such an internal combustion engine-compressor unit can be enhanced, particularly if it is an internal combustion engine with external combustion, when the gas outlet orifice of the internal combustion engine is connected to a heat exchanger which heats the compressed fresh air or the compressed fuel-fresh air mixture which flows from the compressor to the gas inlet aperture in the gas supply line. Expediently, the heat exchanger forms a part of the wall of the housing in the region of the gas outlet orifice. In this way, the comparatively large gas outlet angle of the internal combustion engine can be used for efficient heat recovery.

In a preferred development, the heat exchanger has an exchanger body with, adjacent the gas outlet orifice, first passages which extend substantially radially in relation to the first axis of rotation and second passages leading from the compressor to the gas inlet aperture and extending substantially in the tangential direction of the cylinder rotor. The heat exchanger which is expediently flanged directly on the housing uses the waste gases without any essential narrowing of the cross-section and without flow losses, so that the waste gases can also be used subsequently to operate a waste gas turbine which drives the compressor.

A further aspect of the invention relates to the dissipation of the heat generated in the cylinder rotor. For this purpose, the cylinder rotor has on at least one of its side walls annular and mutually coaxial cooling fins between which engage complementary annular cooling fins on the housing and which project from the oppositely disposed side face of the housing. By virtue of their enlarged surface area, the cooling fins form a labyrinth which transmits the heat from the cylinder rotor to the engine block. The labyrinth is expediently adjacent the lubricating oil circuit of the internal combustion engine in order to increase the cooling output. In conventional manner, the housing can be air-cooled or water-cooled and thus also take over cooling of the oil flowing through the labyrinth. A splash disc provided at the transition from the outer shell of the cylinder rotor to the cooling fin labyrinth seals the latter vis-a-vis the periphery of the cylinder rotor and delivers the oil flowing in the labyrinth seal into a substantially pressure-less peripheral chamber of the housing from which it is fed back to the oil circuit of the engine.

The invention will be explained in greater detail hereinafter with reference to the accompanying drawings in which.

Figure 1:
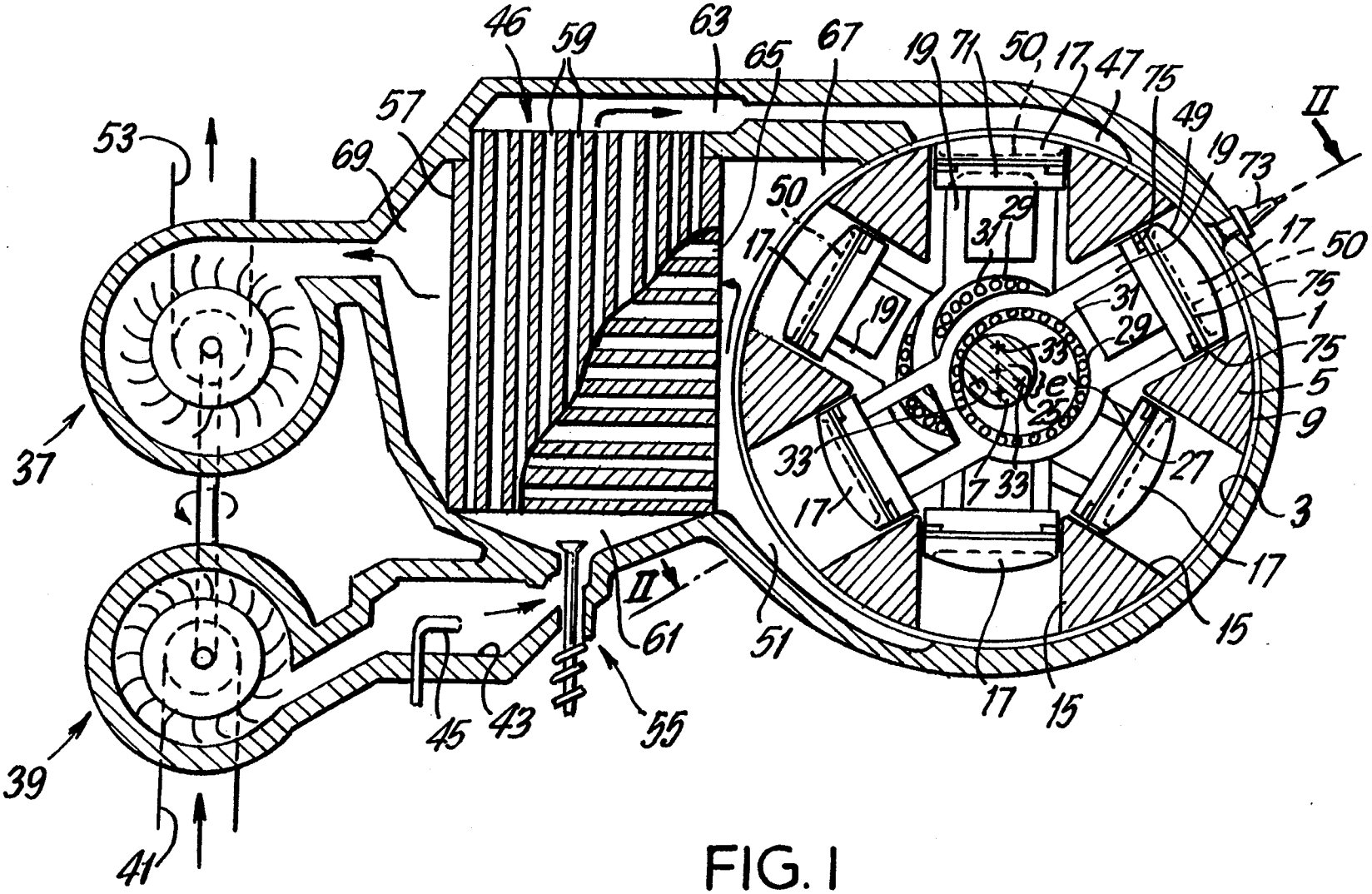
FIG. 1 is a diagrammatic sectional view of an embodiment of reciprocating internal combustion engine according to the invention.
Figure 2:
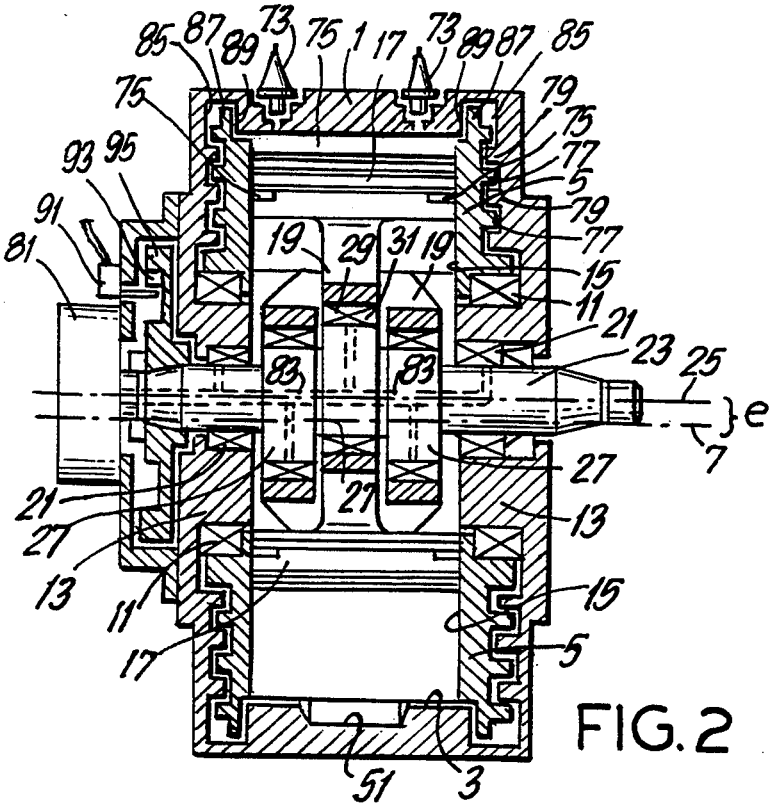
FIG. 2 is a sectional view of the internal combustion engine seen along the line II—II in FIG. 1.

The internal combustion engine shown in FIGS. 1 and 2 comprises a housing 1 having a substantially cylindrical interior 3 in which there is a likewise substantially cylinder rotor 5 which is adapted to rotate about an axis of rotation 7. The cylinder rotor 5 has, concentric with the axis of rotation 7, a substantially cylindrical peripheral wall 9 which is closely enclosed by the interior 3 and is mounted via rolling-type bearings 11 on bearing projections 13 in the housing 1.

The cylinder rotor 5 comprises six cylinders 15 in each of which a piston 17 is disposed for displacement at right-angles to the axis of rotation 7. The cylinders 15 or pistons 17 are disposed in pairs on opposite sides of the axis of rotation 7 and are aligned in respect of one another, i.e. they are equiaxial. The axes of the pairs of cylinders are angularly offset by 120° about the axis of rotation 7 and lie in the same axially normal plane of the cylinder rotor 5 but they can also be somewhat offset in respect of one another in the direction of the axis of rotation 7. The pair-wise associated pistons 17 are rigidly connected to one another by piston rods 19.

In the housing 1, a crank shaft 23 is mounted to rotate in rolling-type bearings 21 about an axis of rotation 25 which is axially parallel with and offset by an eccentricity e in relation to the axis of rotation 7. The crank shaft 23 has three axially adjacently disposed fixed circular cam discs 27 seated in bearing apertures 29 in the piston rods 19, guiding the piston rods 19 through needle bearings 31. The circular cam discs 27 define eccentric bearings having eccentric axes of rotation 33 which are axially parallel with the axis of rotation 25 of the crank shaft 23 but offset from the axis of rotation 25 by the value of the eccentricity e. The eccentric axes of rotation 33 of the three circular cam discs 27 are likewise angularly offset by 120° from one another about the axis of rotation 25. The circular cam discs 27 have a radius which is greater than the eccentricity e and they are only connected to one another in the region of their radial overlap. Thus, only portions of the circles of the other circular cam discs project beyond the peripheral surfaces of the individual circular cam discs 27. This has the advantage that the needle bearing 31 of the middle circular cam disc 27 can be threaded over the two outer circular cam discs 27. In the preferred development illustrated, the working surfaces of the needle bearings are in each case formed directly by the peripheral surfaces of the circular eccentric discs 27 or the (in the peripheral direction) inner surfaces of the bearing apertures 29. In such a case, it is sufficient for the roller bearing cage provided for guiding the needle bodies to be divided for example into two halves so that the middle needle bearing can be fitted while the piston rod 19 is not divided. Within the framework of the invention, needle bearings are preferred because they have more favourable friction properties which, as will be explained hereinafter, is advantageous when dimensioning the internal combustion engine for relatively high output levels.

Figure 4:
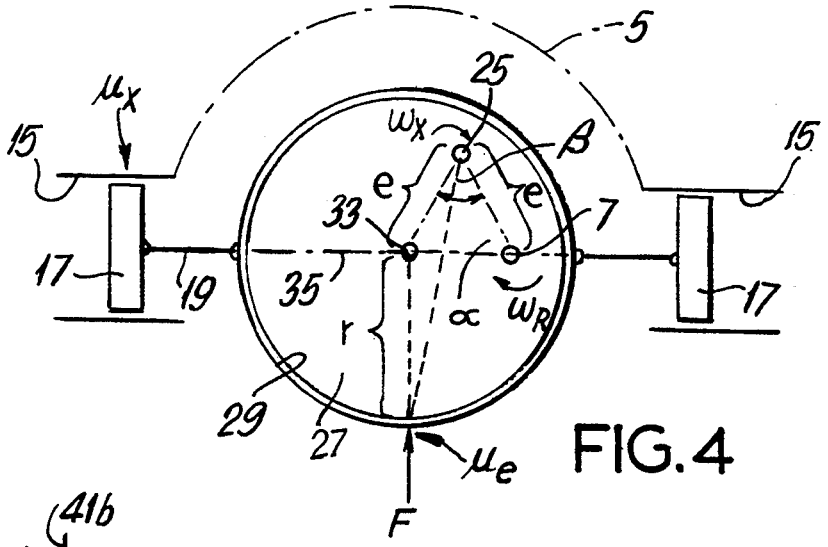
FIG. 4 is a diagrammatic drawing to explain the cam disc transmission of the internal combustion engine.

As is best shown by the diagram in FIG. 4 for one of the pairs of pistons 17, upon rotation of the cylinder rotor 5, the pistons 17 move about the axis of rotation 7 along a path 35 which cuts the axis of rotation 7 in an axially normal plane. The eccentric axis of rotation 33 coincident with the, axis of the centre point of the circular cam disc 27 moves along the path 35 also since the eccentricity gap e from the axis of rotation 25 of the crank shaft 23 is equal to the eccentricity gap e of the axis of rotation 25 from the axis of rotation 7 of the cylinder rotor 5. The three pairs of pistons are guided in torsionally rigid fashion on the crank shaft 23 exclusively via their piston rods 19, which is made possible by the fact that the circular cam discs 27 are fixed in relation to one another and in relation to the crank shaft 23. The crank shaft 23 is positively rotated in relation to the cylinder rotor 5, in the same direction as the cylinder rotor 5 at an angular velocity $\omega k$ which is twice as great as the angular velocity $\omega_R$, at which the cylinder rotor 5 rotates about its axis of rotation 7.

Since the piston travel is equal to four times the eccentricity e, the eccentricity e is in practice comparatively small being for instance of the order of 10 to 20 mm. Nevertheless, the crank shaft 23 can be of stable construction since the bearing circle radius r of the circular cam discs 27 can without problem be of larger dimensions than the eccentricity e. The choice of a comparatively large value of r is desirable since in this way it is possible to have relatively large piston forces with relatively small axial width of the circular cam discs 27 or needle bearings 29.

During the course of piston movement, the eccentric axis of rotation 33 moves away via the axis of rotation 7 of the cylinder rotor 5. When the axes of rotation 33 and 7 coincide, the associated pair of pistons, considered by themselves, could be rotated about the axis of rotation jointly with the cylinder rotor 5. In the case of cylinder rotor reciprocating engines having mutually freely rotatable cam discs, this effect can cause resonance during operation. The tendency of the internal combustion engine according to the invention to suffer from resonance is however diminished since in any position of rotation of at least two pairs of pistons which are offset by 120° from one another, the cylinder rotor is rotationally rigidly coupled to the crank shaft 23.

Surprisingly, it has been found that the bearing circle radius r of the circular cam discs 27 cannot be of just any chosen size, since upon the reciprocating engine being driven by the cylinder rotor 5, a self-locking effect can occur in certain angular portions of the eccentric movement and this would cause the cylinder rotor 5 to jam. The thrust force F (FIG. 4) applied during thrust operation of the internal combustion engine by the moment of inertia of the cylinder rotor 5 in relation to the braked crank shaft 23 generates, by virtue of a knee lever effect with a small intermediate angle $\beta$, friction forces between the piston 17 and the cylinder 15 on the one hand and the bearing aperture 29 and the circular cam disc 27 on the other which counteract any self-locking displacement movement of the pair of pistons. The displacement movement of the pair of pistons brings about a rotary movement of the circular cam disc 27 about the axis of rotation 25. Since, by virtue of the fact that the torsion arm increases as the gap r grows, the inhibiting friction moments become greater, there is an upper limit for these dimensions which must not be exceeded if the self-locking effect is to be avoided. It has been found that, when the reciprocating engine is being driven by the crank shaft 23 (compressor operation) or when it is being driven from the piston side (engine operation), the self-inhibiting effect when the cylinder rotor 5 is provided in the drive can however be overcome if the parameters which determine the friction force are so chosen that an angular zone $\alpha$ of the angle of rotation of the cylinder rotor 5 in which, when it is the cylinder rotor 5 which is providing the drive, is less than 60° when considering only one individual pair of pistons. The angle $\alpha$ in this case refers to the angle between the plane containing the axes of rotation 7 and 25 in relation to the direction of displacement of the pair of pistons considered. Adopting as a premise the situation outlined in FIG. 4, it is possible to estimate the following equation as being relevant for overcoming the self-locking or self-inhibiting effect:

$$\arctan \mu_k^{-1} - \arcsin \frac{r/e}{\sqrt{1 + \mu_e^{-2}}} < \frac{\pi}{3}$$

in which $\mu_e$ is the coefficient of friction of the eccentric bearing $\mu_k$ is the coefficient of friction of the piston 17 in the cylinder 15 r is the radius of the bearing circle of the eccentric bearing and e is the distance between the axis of rotation 7 and the axis of rotation 25.

If a needle bearing is used, the attainable ratio of r:e is less than 4 and normally about 2.5 to 3.

As FIG. 1 shows, the internal combustion engine comprises a compressor 39 driven by a waste gas turbine 37 which compresses fresh air supplied through an inlet 41 and feeds it to a stationary mixing chamber 43 in which fuel is admixed through a nozzle 45. The compressed fuel-air mixture is heated in a heat exchanger 46 in the exhaust gas line leading to the waste gas turbine 37 and fed to an inlet aperture 47 virtually tangentially in relation to the cylinder rotor 5 and through which inlet aperture 47 the cylinders 15 can be charged with the compressed and pre-heated fuel-air mixture. The inlet aperture 47 starts in the direction of rotation of the cylinder rotor 5 from a position associated with the radially outer dead centre position of the pistons 17 and is formed by a peripheral groove in the peripheral surface of the interior 3 of the housing 1 which is opposite the peripheral wall 9 of the cylinder rotor 5. To avoid charging pressure losses, the cylinders 15 are, over substantially their entire cross-section, open to the peripheral wall 9 of the cylinder rotor 5 and the pistons 17 have a piston crown 49 which follows the cylindrical contours of the peripheral surface 9 like a portion of a cylinder, in which at least one depression 50 is provided. The depression 50 leaves in the radially outer dead centre position of the piston 17 a small volume of dead space which, since the inlet aperture 47 already starts before the outer dead centre position, improves the filling of the combustion space with fresh mixture. It will be understood that the volume of dead space may possibly be dispensed with or may be provided by a special configuration of the inlet aperture 47 or an enlargement of the radial dimensions of the cylinder rotor.

In the direction of rotation, the mixture is remotely ignited while offset in relation to the radially outer dead centre position and it drives the piston during the working phase into the radially inner dead centre position which, in relation to the axis of rotation 7, is diametrically opposite the radially outer dead centre position. In the direction of rotation of the cylinder rotor 5, following the position of the radially inner dead centre position, there is in the housing 1 and likewise constructed as a groove, an outlet orifice 51 which is open towards the peripheral surface 9 of the cylinder rotor 5 and in which the waste gases are fed through the heat exchanger 46 to the waste gas turbine 37 from which they emerge via an outlet 53.

The heat exchanger 46 disposed in the mixture feed path enhances the efficiency of the internal combustion engine in that it utilises the waste gas heat in order further to increase the pressure in the fuel-air mixture. To prevent retroaction on the compressor turbine 39, there is between the mixing chamber 43 and the heat exchanger 46 a spring-loaded non-return valve 55.

The heat exchanger 46 consists of an exchanger block 57 of readily heat-conductive material and which has in a plurality of mutually parallel planes a plurality of passages 59 extending substantially tangentially in relation to the cylinder rotor 5, the ends of which passages discharge into common collecting spaces 61 and 63, delivering to the inlet aperture 47 the mixture of fuel and air emanating from the mixing chamber 43. Between the planes containing the passages 59 there are a respective plurality of passages 65 extending transversely thereto and which extend radially to the cylinder rotor 5 and through which the waste gases flow to the waste gas turbine 37 without any substantial deflection with the flow losses which would result. The exchanger block 57 is flanged directly on the housing 1 so that the space remaining between the exchanger block 57 and the peripheral surface 9 of the cylinder rotor 5 forms a collecting space 67 for waste gases. A further collecting space 69 is provided on that side of the passages 65 which is remote from the cylinder rotor 5.

Figure 3:
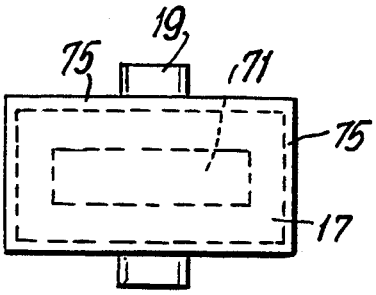
FIG. 3 is a plan view of one of the pistons of the internal combustion engine.

The combustion temperature in the cylinders 15 is comparatively high. Therefore, the pistons 17 consist of ceramic material and are fixed, for example bolted, onto head parts 71 (FIGS. 1 and 3) of the piston rods 19 which are made from metal. As is best illustrated in FIG. 3, in radial plan view, the pistons are of rectangular cross-section and their narrow sides extend in a peripheral direction. In spite of the comparatively large piston area, it is thus possible to achieve a compact construction of the internal combustion engine. In order to achieve sufficiently regular flame fronts, a plurality of—in this case two—sparking plugs 73 are provided. The pistons are sealed by straight sealing strip portions 75 which are resiliently inserted into grooves in the side walls of the pistons. The sealing strip portions 75 of adjacent side walls of the piston 17 are offset in relation to each other radially of the axis of rotation 7 and overlap in the corner regions of the pistons. Therefore, in the corner regions of the pistons there are double-acting seals.

Figure 3A:
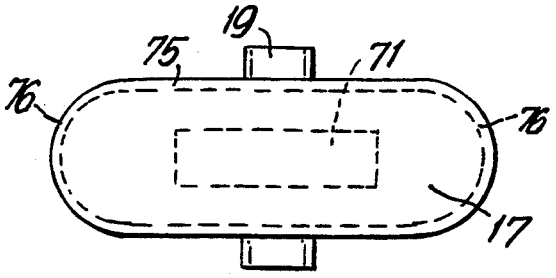
FIG. 3A is a plan view of an alternative embodiment of a piston of the internal combustion engine.

FIG. 3A shows an alternative embodiment of the piston 17 in which the piston 17 is in turn narrower in the peripheral direction of the cylinder rotor than in the direction of the axis of rotation of the cylinder rotor. The piston has a virtually oval cross section, the narrow sides being formed by semi-cylindrical surfaces, which merge into flat areas of the broad sides. For sealing the pistons, U-shaped sealing strip segments 76 are inserted into grooves encircling the piston from the semi-cylindrical narrow sides and accommodate the piston between their arms. It will be understood that in order to improve the sealing effect the arms of oppositely disposed sealing strip segments may overlap and that, as usual, in order to increase the applied pressure, resilient sealing strip portions may be provided.

FIG. 2 shows details of the cooling and lubricating system of the internal combustion engine. Projecting from the axially disposed end faces of the cylinder rotor 5 are a plurality of annular cooling fins 77 disposed within one another and coaxially of the axis of rotation 7 and between which engage the complementary annular cooling fins 79 which are disposed in one another coaxially and which likewise project axially from the relevant side walls of the housing 1. The cooling fins 77, 79 form, axially on both sides of the cylinder rotor 5, labyrinths which by virtue of their enlarged surface, facilitate the transfer of heat from the cylinder rotor 5 to the housing 1. Adjacent the cooling fins 79, the housing 1 can comprise cooling water passages not shown in greater detail but which are connected to a cooling water circuit of the internal combustion engine and which dissipate the heat from the housing 1. Also the casing of the housing 1 can, in order to improve the cooling effect, comprise a plurality of axial cooling water passages.

For a further improvement of the cooling effect, the labyrinths formed by the cooling fins 77, 79 are connected to the oil circuit of the internal combustion engine. An oil pump driven by the crank shaft 23 and indicated at 81 delivers the lubricating oil through oil passages 83 to the region of the radially inner periphery of the labyrinth. Due to the centrifugal action of the rotating cylinder rotor 5, the lubricating oil is conveyed via the labyrinths to pressureless collecting passages 85 in the housing 1 which radially outwardly define the labyrinth in the region of the outer periphery of the cylinder rotor 5. At the transition between the peripheral surface 9 of the cylinder rotor 5 and its axial side faces, there are provided on the cylinder rotor 5 splash discs 87 which together with matching axial surfaces 89 on the housing 1, form sealing labyrinths and throw the oil into the collecting spaces 85.

In this way, it is possible to prevent oil passing to an undesired extent into the gas exchange passages 47, 51 in the housing 1. The lubricating oil flowing through the labyrinth in the cooling fins 77, 79 improves the transfer of heat from the cylinder rotor 5 to the housing 1 and is furthermore cooled in turn by the possibly cooled side walls of the housing 1.

The ignition system may be of conventional construction and for control purposes it may comprise a magnetic switch 91 which responds to magnets 93 on a wheel 95 seated on the crank shaft 23, the magnets being distributed in a peripheral direction.

Alternative embodiments of internal combustion engine are explained hereinafter. Parts shown in the drawings are identified by the same reference numerals as in FIGS. 1 and 2, a letter being added to allow the distinction. To explain the construction and mode of action, reference is made to the description of the example of embodiment shown in FIGS. 1 and 2.

Figure 5:
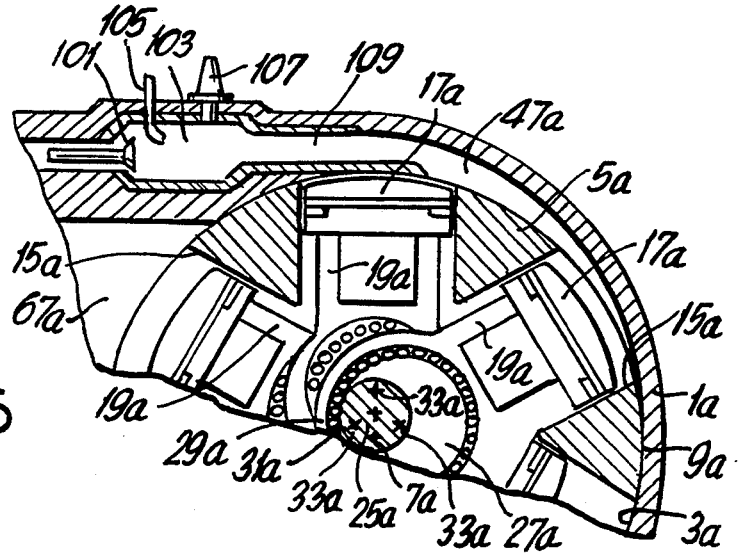
FIG. 5 is a partially sectional view of an alternative form of internal combustion engine from FIG. 1.

The alternative form of internal combustion engine as shown in FIG. 5 differs from that shown in FIGS. 1 and 2 essentially only by the nature of the combustion chamber configuration. In addition, in the heat exchanger which is not illustrated in greater detail, only the compressed fresh air is heated and fed via a non-return valve 101 which is spring-loaded in a manner not shown in greater detail, to a combustion chamber 103 which is stationary in the housing 1*a*. Via a jet 105, the fuel is injected into the combustion chamber, 103 and is periodically remotely ignited by a sparking plug 107. The outlet port 109 of the combustion chamber, extending substantially tangentially of the cylinder rotor 5*a* discharges into, open towards the peripheral surface 9*a* of the cylinder rotor 5*a*, a passage 47*a* which establishes the inlet aperture. Thus, the cylinder rotor 5*a* is driven after the fashion of a turbine by the expanding waste gases which emerge periodically from the combustion chamber 103. The non-return valve 101 prevents retroaction of the working pressure of the combustion chamber 103 on the precedent compressor which compresses the fresh air.

Figure 6:
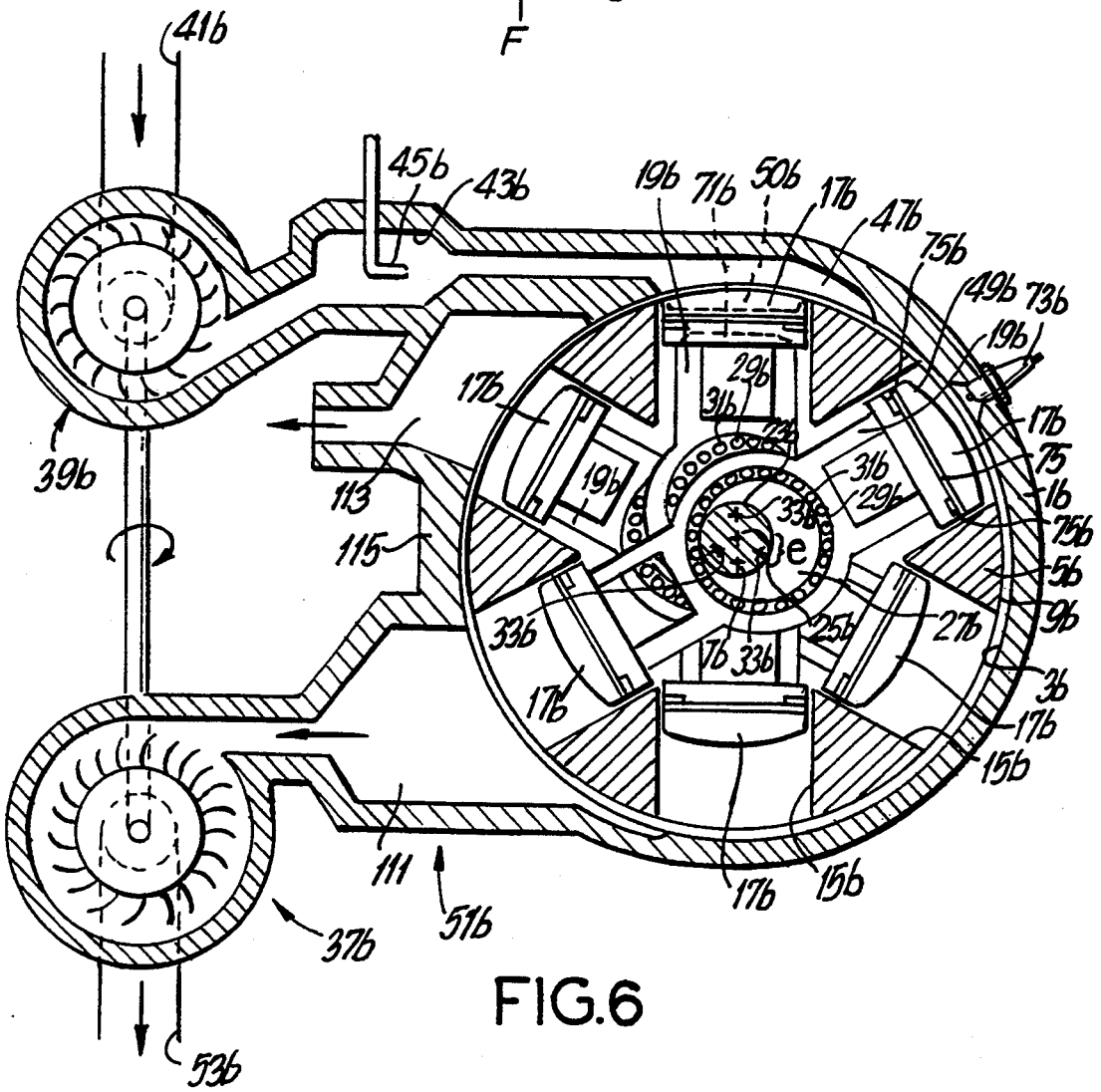
FIG. 6 is a sectional view through a further alternative embodiment of internal combustion engine to that shown in FIG. 1.

FIG. 6 shows an alternative form of internal combustion engine which differs from that in FIGS. 1 and 2 mainly by the configuration of its outlet orifice 51*b*. the outlet orifice 51*b* is subdivided into two outlets 111, 113 which follow each other in the peripheral direction of the cylinder rotor 5*b* around the periphery of the housing 1*b*. The outlets 111, 113 are separated from each other by a wall portion 115 of the housing 1*b* which is broader in the peripheral direction than the end orifice of each of the cylinders 15*b* in order thus to prevent a direct shunting of the waste gases between the two outlets 111, 113 when passing the cylinder 15*b*. Connected to the outlet 111 which is in a peripheral direction closer to the radially inner dead centre position of the pistons 17*b* is the waste gas turbine 37*b* which in this way is operated by the waste gases emerging at high pressure from the start of the outlet. The outlet 113 follows in the direction of rotation of the cylinder rotor 5*b* and, since it does not have to work against the pressure of a turbine, it ensures that the waste gases are able to expand substantially. By virtue of the subdivision of the outlet orifice 51*b* into two successive outlets, of which only the first outlet is used to drive the waste gas turbine 37*b*, can the charge exchange be improved. A heat exchanger (parts 46 and 57 to 69) is not shown but it can however in modified form be provided for the exchange of heat between waste gases and compressed fresh air. Alternatively, however, also the pre-compressed mixture can be cooled in order to achieve a high charging density before it is charged into the internal combustion engine.

Figure 8:
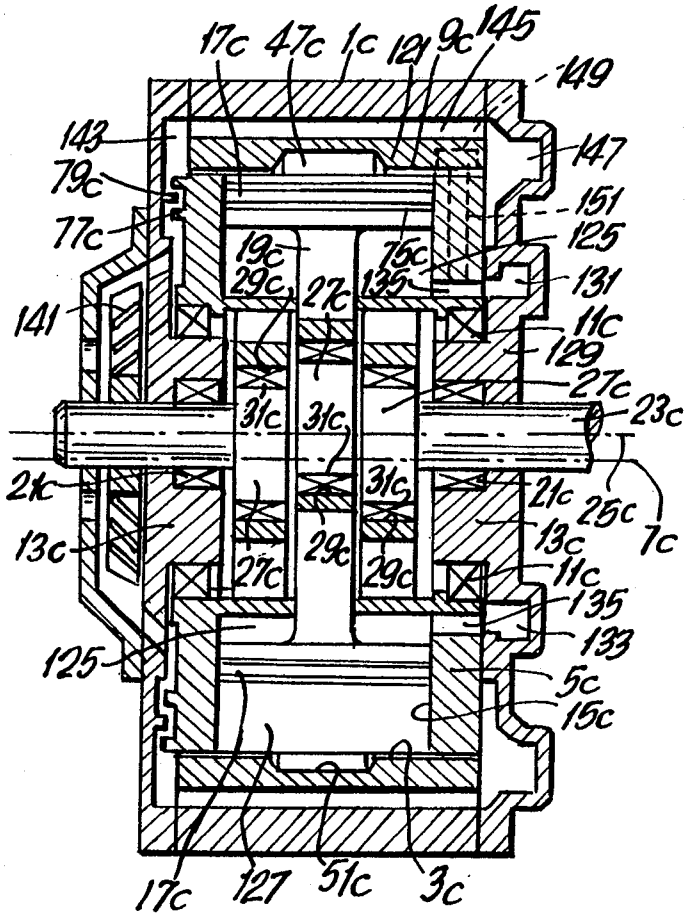
FIG. 8 is a sectional view of the internal combustion engine, viewed along a line VIII—VIII in FIG. 7.
Figure 7:
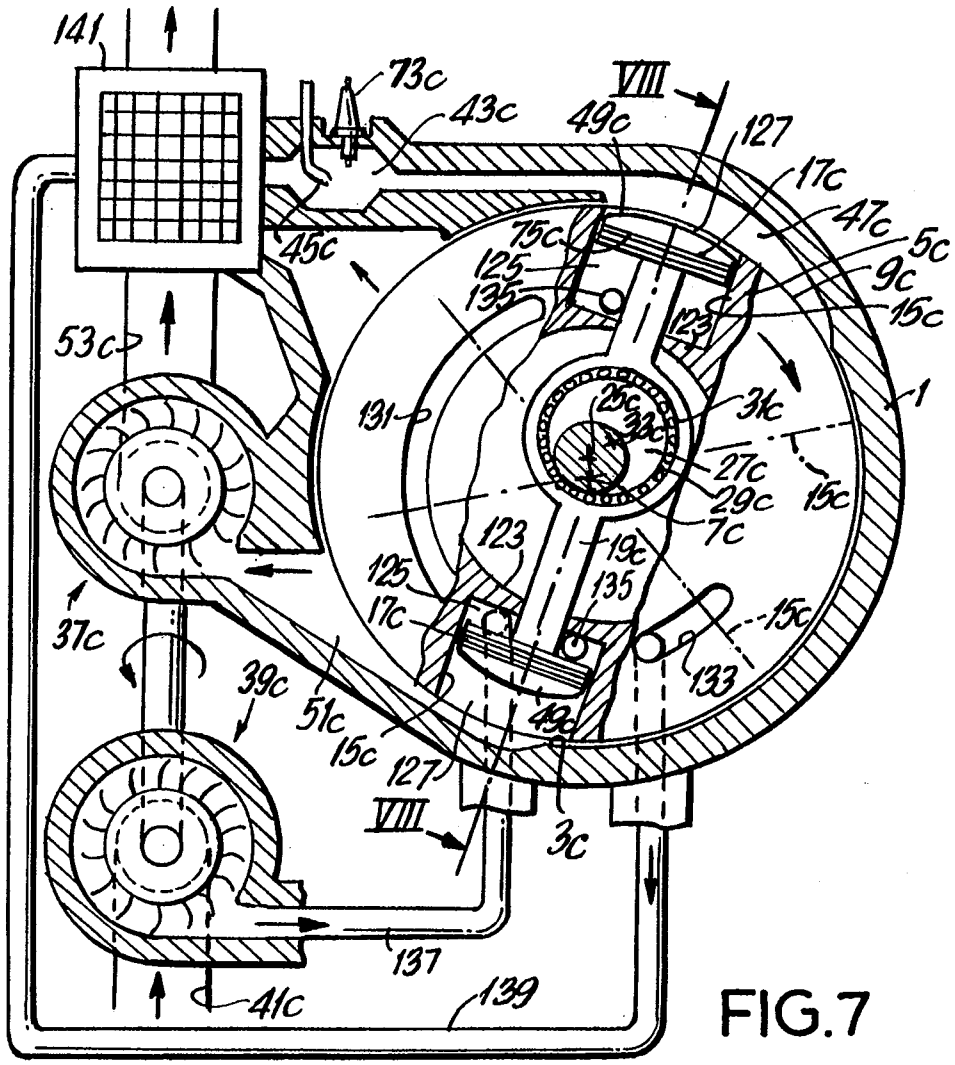
FIG. 7 is a diagrammatic sectional view of a reciprocating internal combustion engine with an integral compressor.

FIGS. 7 and 8 diagrammatically show an alternative form of internal combustion reciprocating engine of the type explained with reference to FIGS. 1 and 2 in which each of the cylinders 15*c* is closed not only radially outwardly by a peripheral wall 121 of the housing 1*c* but also radially inwardly by, ends 123 of the cylinder rotor 5*c*. The piston rods 19*c* which in turn rigidly connect the pistons 17*c* to each other in pairs are passed through the ends 123 in sealing-tight fashion. Thus, each of the pistons 17*c* subdivides the cylinder 15*c* into two working spaces 125 or 127 of which the radially inner working space 125 is used as a compression space while the radially outer working space 127 is used as a combustion chamber. Disposed in a curved arrangement in an end wall 129 of the housing 1*c* are an inlet port 131 and an outlet port 133, being curved about the axis of rotation 1c of the cylinder rotor 5c and during an induction phase in which the piston 17c is moved radially outwardly, they are aligned with an aperture 135 discharging into the radially inner space 125. The outlet passage 133 is aligned with the aperture 135 towards the end of the compression phase.

The compressor formed by the radially inner spaces 125 is charged by the compressor 39c with pre-compressed fresh air supplied at 41c. For this purpose, the compressor 39c is connected to the inlet port 131 by a passage 137. The waste gas turbine 37c connected to the waste gas outlet 51c of the internal combustion engine drives the compressor turbine 39c. The waste gases flowing from the outlet 53c of the waste gas turbine 37c heat the compressed fresh air supplied to the combustion chamber 43c through a connecting passage 139 from the outlet port 133 in a heat exchanger 141. The combustion chamber 43c is situated outside the radially outer spaces 127 of the cylinder rotor 5c. The fuel is injected through the injection jet 45c into the combustion chamber 43c where it is also ignited by means of the sparking plug 73c. It will be appreciated that the sparking plug 73c may also be disposed in the peripheral wall 121 of the housing 1c so that the mixture is ignited in the combustion chambers 127.

The peripheral wall 121 must closely surround the periphery 9c of the cylinder rotor 5c. In order to be able to compensate for tolerances, the peripheral surface 9c of the cylinder rotor 5c is of slightly conical form while the inner surface of the peripheral wall 121 is constructed as a matching inner cone. In a manner not shown in greater detail, the peripheral wall 121 can be axially adjusted to compensate for tolerances.

For cooling the internal combustion engine, there is fitted on the crank shaft 23c a compressor wheel 141 which delivers cooling air into a labyrinth gap 143 formed by annular fins 77c, 79c on the cylinder rotor 5c and the housing 1c. The cooling air is fed into the radially inner portion of the labyrinth gap 143 and flows through axial passages 145 provided both in the housing 1c and also between the cylinders 15c in the cylinder rotor 5c, to the axially opposite side. Annular passages 147 carry the cooling air away.

As indicated at 149 in FIG. 8, the inlet and outlet ports 131, 133 can also be provided in the peripheral wall 121 instead of the end wall 129. The aperture 135 is then extended through radial passages 151 to the periphery 9c.

The internal combustion engine explained hereinabove can also be used as a double-action compressor when the radially outer spaces 127 are likewise used as compressor spaces.

Hereinabove, examples of embodiment have been explained in which only one single group of three pistons or pairs of cylinders are provided. It will be appreciated that also a plurality of such groups may be disposed axially beside one another on a common crank shaft. These groups may all work as an internal combustion engine or alternatively it is also possible to disposed compressor and internal combustion engines axially beside one another.

I claim:

1. An internal combustion reciprocating engine, comprising:

a housing;

a cylinder rotor supported in said housing for rotation about a first axis of rotation, wherein said cylinder rotor includes at least three pairs of cylinders angularly offset relative to each other about the first axis of rotation by 120°, wherein cylinders of each pair are arranged on opposite sides of the first axis of rotation and have a common axis extending perpendicular to the first axis of rotation, wherein a piston is arranged in each cylinder for displacement therein, and wherein a piston rod rigidly connects the pistons of each of the pairs of cylinders;

a crankshaft supported in said housing for rotation about a second axis of rotation extending parallel to the first axis of rotation and offset relative thereto by a predetermined eccentricity;

eccentric bearings supported on said crank shaft for guiding the piston rods of the pairs of cylinders, wherein said eccentric bearings define third axes of rotation which are offset relative to each other about a second axis of rotation by 120°, wherein the third axes of rotation extend parallel to the second axis of rotation and are spaced from the second axis of rotation by the predetermined eccentricity, and further wherein each of said eccentric bearings comprises a cam disc fixedly supported on said crankshaft and is received in a bearing opening of a respective piston rod, and wherein the axes of said cam discs define the third axes of rotation;

wherein said cam disc has a bearing radius which is greater than the predetermined eccentricity, and wherein the ratio of the bearing radius to the predetermined eccentricity is approximately between 2.5 and 3.

2. The internal combustion reciprocating engine of claim 1, wherein said housing has at least one inlet aperture and at least one outlet aperture, wherein each of said cylinders has opening means communicating with said inlet and outlet apertures during rotation of said cylinder rotor, wherein said engine further comprises a compressor communicating with said gas inlet aperture for introducing fresh gas into a respective cylinder when it passes said gas inlet aperture, and wherein the piston which is displaceable in the respective cylinder has a radially outer dead center position, and further wherein the respective cylinder has a dead space volume and said gas inlet aperture is so arranged that the dead space volume of the respective cylinder is charged with fresh gas before the piston reaches the radially outer dead center position thereof.

3. The internal combustion reciprocating engine of claim 2, wherein the piston has a crown having at least one depression defining the dead space volume of the respective cylinder.

4. The internal combustion reciprocating engine of claim 1, wherein said housing has at least one inlet aperture and at least one outlet aperture, wherein each of said cylinders has opening means communicating with said inlet and outlet apertures during rotation of said cylinder rotor, wherein said gas outlet aperture comprises separate first and second outlets arranged one after another in a rotational direction of said cylinder rotor, and wherein said engine further comprises a waste gas turbine communicating with said first outlet.

5. The internal combustion reciprocating engine of claim 4, wherein said housing has a wall portion which separates said first and second outlets and which has a width greater than a width of an open end of the cylinder.

6. The internal combustion reciprocating engine of claim 1, wherein said piston has an axial dimension which is greater than a circumferential dimension thereof.

7. The internal combustion reciprocating engine of claim 6, wherein said piston has flat axial sides and peripheral sides which are one of flat and semi-cylindrical.

8. The internal combustion reciprocating engine of claim 7, wherein the axial and peripheral sides of said piston have grooves therein for receiving sealing strips overlapping each other in transitional regions between grooves of the axial and peripheral sides.

9. The internal combustion reciprocating engine of claim 2, further comprising:

a waste gas turbine for driving said compressor; and fuel feed means for supplying fuel into a stream of fresh gas flowing from said compressor to said gas inlet aperture; and a heat exchanger communicating with said gas outlet aperture for heating one of the fresh gas and a mixture of fresh gas and fuel.

10. The internal combustion reciprocating engine of claim 9, wherein said heat exchanger forms a part of a wall of said housing in a region of said gas outlet aperture.

11. The internal combustion reciprocating engine of claim 9, wherein said heat exchanger has a body, first passages which are formed in said body and which extend substantially perpendicular to the first axis of rotation, and which are open in a vicinity of said gas outlet aperture, and wherein said heat exchanger has second passages extending, in a tangential direction with respect to said cylinder rotor, in a flowing path of the fresh gas from said compressor to said gas inlet aperture.

12. The reciprocating combustion engine of claim 1, wherein at least one of the end faces of said cylinder rotor and an inner surface of a wall of said housing which faces said at least one end face have cooling fins thereon which extend one of parallel to the first axis of rotation and interengage with each other to form a labyrinth.

13. The internal combustion reciprocating engine of claim 12, wherein said labyrinth has inner and outer peripheries connected with an oil circuit, wherein said housing has a peripheral chamber for closing said labyrinth at one side thereof, and wherein said cylinder rotor has a splash disc extending into said peripheral chamber to form a labyrinth seal adjacent an axial end wall of said housing.

14. An internal combustion reciprocating engine comprising:

a housing;

a cylinder rotor supported in said housing for rotation about a first axis of rotation, wherein said cylinder rotor includes at least three pairs of cylinders angularly offset relative to each other about the first axis of rotation by 120°, wherein cylinders of each pair are arranged on opposite sides of the first axis of rotation and have a common axis extending perpendicular to the first axis of rotation, wherein a piston is arranged in each cylinder for displacement therein, and further wherein a piston rod rigidly connects pistons of each of the pairs of cylinders;

a crankshaft supported in said housing for rotation about a second axis of rotation wherein said crankshaft extends parallel to the first axis of rotation and is offset relative thereto by a predetermined eccentricity;

eccentric bearings supported on said crankshaft for guiding piston rods of the pairs of cylinders, wherein said eccentric bearings defined third axes of rotation which are offset relative to each other about a second axis of rotation by 120°, wherein the third axes of rotation extend parallel to the second axis of rotation, and are spaced from the second axis of rotation by the predetermined eccentricity, wherein each of said eccentric bearings comprises a cam disc fixedly supported on said crankshaft and are received in a bearing opening of a respective piston rod, wherein axes of said circular cam discs define the third axes of rotation;

wherein said housing has at least one inlet port and at least one outlet port, wherein each of said cylinders has radially outer and inner chambers, which are defined by the piston, and wherein said radially inner chamber communicates with said inlet and outlet ports during rotation of said cylinder rotor.

15. The internal combustion reciprocating engine of claim 14, wherein said radially outer chamber has a gas inlet aperture, and wherein said outlet port communicates with said gas inlet aperture.

16. The internal combustion reciprocating engine of claim 15, wherein said radially outer chamber has a gas outlet aperture, said engine further comprising a waste gas turbine communicating with said gas outlet aperture, and a fresh gas compressor, which is driven from said waste gas turbine, communicating with said gas inlet aperture.

17. The internal combustion reciprocating engine of claim 14, wherein said cylinder rotor has a tapering outer peripheral surface, and wherein said housing has an inner tapering peripheral surface complementary to said outer peripheral surface of said cylinder rotor.

* * * * *